United States Patent [19]

Neal

[11] 3,981,436

[45] Sept. 21, 1976

[54] MAIL BOX

[76] Inventor: Louis A. Neal, 57 Hopson Ave., Branford, Conn. 06405

[22] Filed: June 26, 1975

[21] Appl. No.: 590,519

[52] U.S. Cl. ..... 232/17; 232/43.2

[51] Int. Cl.[2] ..... B65D 91/00

[58] Field of Search ..... 232/17, 43.2, 43.1, 232/30, 31, 32, 27, 39; 248/97

[56] References Cited

UNITED STATES PATENTS

| | | | |
|---|---|---|---|
| 651,773 | 6/1900 | Smith | 248/97 |
| 1,135,810 | 4/1915 | Jones | 232/43.2 |
| 3,204,866 | 9/1965 | Brighton | 232/43.2 |
| 3,261,545 | 7/1966 | Frazier | 232/43.2 |
| 3,300,128 | 1/1967 | Jasinski et al. | 232/17 |
| 3,793,756 | 2/1974 | Kay et al. | 232/43.2 X |

*Primary Examiner*—Roy D. Frazier
*Assistant Examiner*—William E. Lyddane
*Attorney, Agent, or Firm*—DeLio and Montgomery

[57] ABSTRACT

A mail box having a conventional hood portion and tilt-type inlet chute and a base portion which includes a frame and a receptacle removably received in the frame, the hood portion being hinged to the frame at the rear thereof and having an extension at the front adapted to retain the receptacle in the frame when the hood is closed, a lock being provided to hold the hood releasably in closed position. The receptacle is intended to be removed, with its contents, at regular collection times, and replaced by an empty receptacle.

4 Claims, 7 Drawing Figures

MAIL BOX

BACKGROUND OF THE INVENTION

The present invention relates to a mail box which has a conventional hood and tilt-type inlet, but in which the hood is hinged to the frame and the frame is adapted to receive a removable receptacle. The hood can be locked in closed position where it prevents removal of the receptacle from the frame. When unlocked and opened the hood permits the receptacle and its contents to be removed and placed in a collection truck, without other handling of the contents.

When collections of mail are made from mail boxes in various locations, indoors or out, the collector normally has to open the box, grasp the pieces of mail by hand and place each hand-full in a mail sack, usually resting on the ground. The mail is necessarily exposed more or less to wind, rain, snow or other weather conditions and pieces may be wet or blown away, requiring immediate pursuit and retrieval. Small pieces of mail in dark corners of the box may be entirely overlooked during one or more collections, particularly at night or under stormy conditions. The mail sack itself must be of sturdy construction but should not be heavy enough to add substantially to the weight of the contents, the total weight being subject to a recommended or required maximum.

It is accordingly an object of the present invention to provide a mail box, particularly of the large freestanding type, wherein a receptacle is removably contained in the base frame, being locked in place by the cooperation of a hinged hood portion.

It is a further object of the invention to provide such a receptacle which is of durable construction and vandal-resistant but light enough to be handled readily when full.

It is another object of the invention to provide such a mail box wherein the hood lock assembly includes means to initiate the opening of the hood when the lock is operated.

It is a still further object of the invention to provide certain improvements in the form, construction, arrangement and materials of the mail box whereby the above named and other objects may effectively be attained.

Trash cans with removable liners are well known and certain wall-type mail boxes, such as post office "drawers" include a receptacle in an enclosure, but the structure disclosed and claimed herein appears to embody features which give it special utility for its intended purpose.

The invention accordingly comprises the features of construction, combination of elements, and arrangement of parts which will be exemplified in the construction hereinafter set forth, and the scope of the invention will be indicated in the claims.

Practical embodiments of the invention are shown in the accompanying drawing, wherein.

Figure 3:
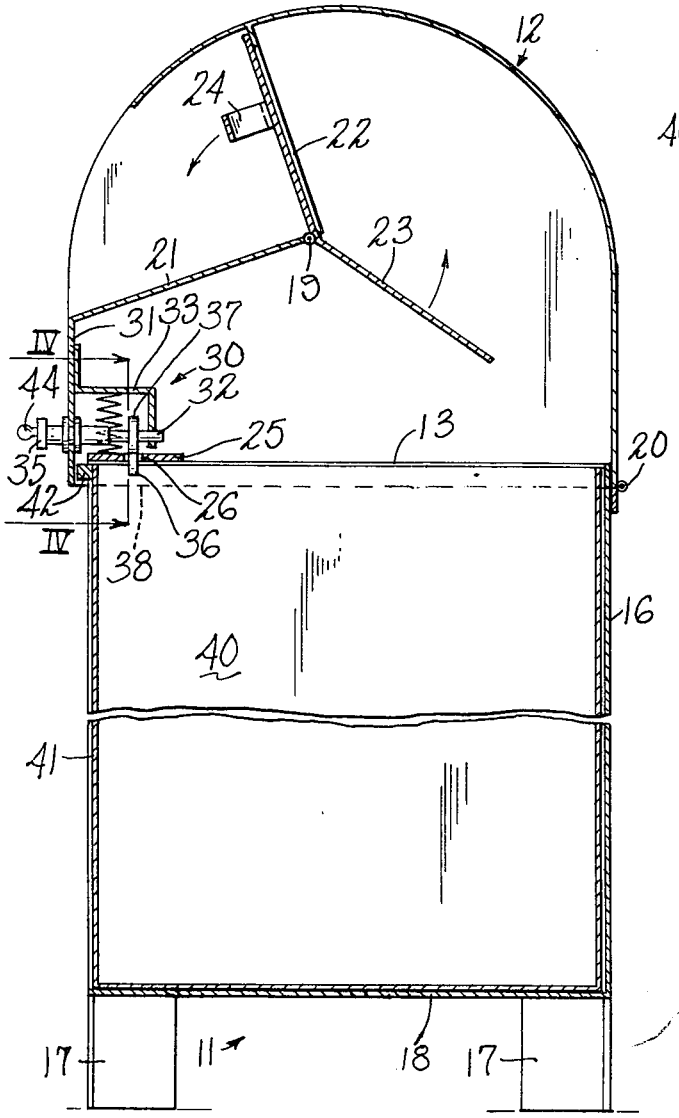
FIG. 3 represents a vertical medial section through the mail box, in closed and locked condition.

Referring to the drawings, the mail box comprises a base 11 and hood 12, the base having solid side panels 13, corner posts 14, 15, a back panel 16, four legs 17, each usually integral with the adjacent corner post, and a flat floor panel 18, the panels and posts being welded and/or riveted together in any customary manner. The side and back panels terminate upwardly in a common horizontal plane and the hood 12, instead of being integral with the side and back panels, is a separate entity, hinged along its rear edge 20 adjacent to the upper edge of the back panel and adapted to fit snugly around the upper periphery of the base with an overlap, as shown in FIG. 3. In its front portion the hood has the usual sloping half-deck 21, tilt-type inlet 22 and deflector 23, pivotally supported on the horizontal axle 19, with an operating handle 24 on the front of the inlet.

All the parts above referred to are normally steel, of suitable gauge.

As shown, the front of the base is open and unobstructed but delimited upwardly by a rigid flat steel locking bar 25, securely fixed at its ends to the upper ends of the corner posts 14. The bar 25 is provided, at its mid-point, with a slot 26 adapted to receive the hook end of the locking hook-cam, as shown in FIGS. 3 and 4.

The locking assembly 30 is mounted at the center of the front wall 31 of the hood and comprises a spindle 32 journaled at its inner end in the bracket 33 which extends rearward from the wall 31, a key-in-handle type cylinder lock 34 operable by the handle 35 and the locking hook-cam, fixed on the spindle 32 and provided with the locking hook 36 and cam 37.

The removable receptacle 40 is rectangular and sized to fit snugly, without jamming or binding, within the base 11. It may be made of a suitable tough and rigid, yet light weight, plastic material such as a glass fiber reinforced plastic, or at least the front panel 41 may be of steel, a major consideration being resistance to cutting or other tampering. The panel 41 includes a flange 42, extending across the front of the panel at its upper edge, and the parts are so proportioned that the lower edge 38 of the hood wall 31 extends, when the hood is closed, closely in front of and slightly below the flange, as shown in FIG. 3.

Figure 6:
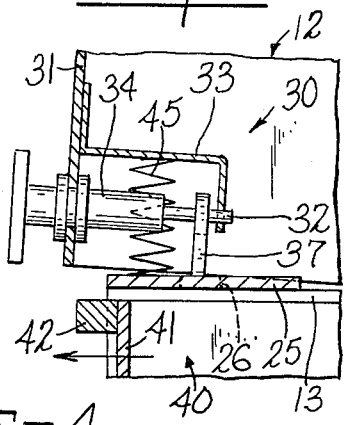
FIG. 6 represents a detail vertical section, as in FIG. 3, but on a larger scale, showing the hood lock assembly in hood opening position.
Figure 4:
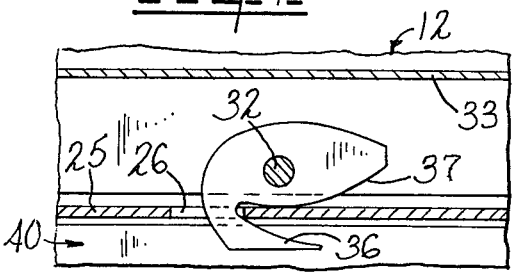
FIG. 4 represents a detail section on the line IV—IV of FIG. 3 showing the locking hook-cam in locked position.
Figure 5:
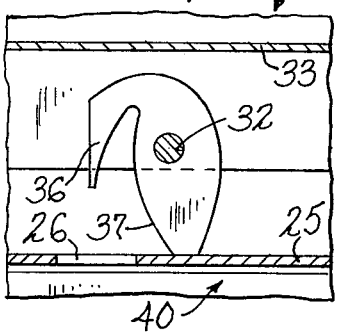
FIG. 5 represents a detail section as in FIG. 6 with the hook-cam in hood opening position.

In operation, with the box closed and locked, the mail collector inserts a key 44 in the handle 35 and turns the handle 90° to rotate the lock-cam from the position of FIG. 4 (locked) to the position of FIG. 5 (unlocked) where the cam 37 has effected the opening movement by lifting slightly on the front of the hood. This lifting may be assisted by coil springs 45 adjacent each end of the bar 25 and arranged to be compressed, when the hood is closed, between said bar and end portions of the bracket 33. The action of the cam 37, aided by springs 45, if used, results in the edge 38 being lifted sufficiently to clear the flange 42, as shown in FIG. 6, so that the flange can be grasped and used as a handle to slide the receptacle 40 out of the base, ready to be placed in an adjacent mail truck with no handling whatever of the collected mail. An empty receptacle is then inserted in the base, and the handle is turned to lower and lock the hood until it is time for another collection.

Figure 7:
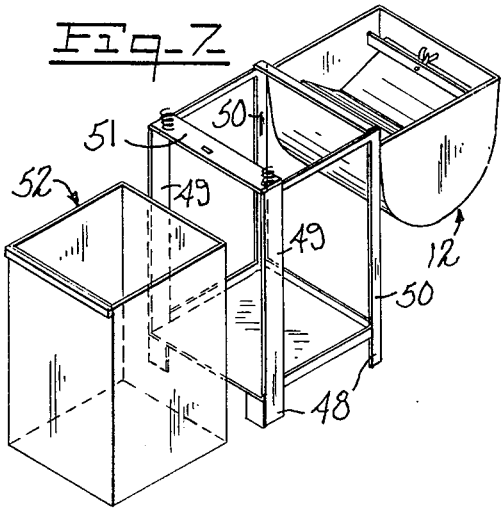
FIG. 7 represents a perspective view, as in FIG. 2, of a modified form of mail box.

In the modified form of mail box shown in FIG. 7 the base is simplified by the omission of the side and back panels, leaving only the legs 48, front and rear corner posts 49, 50 (the latter being of angular cross-section) and the locking bar 51. The hood and locking elements are the same as those described above and the receptacle 52 is the same size and shape but must have all four sides of materials which will resist cutting. The operation of this modified form is as previously described.

Figure 1:
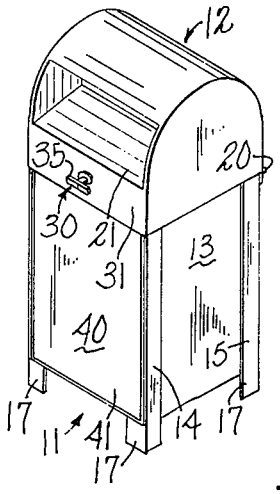
FIG. 1 represents a perspective view of the mail box, closed.
Figure 2:
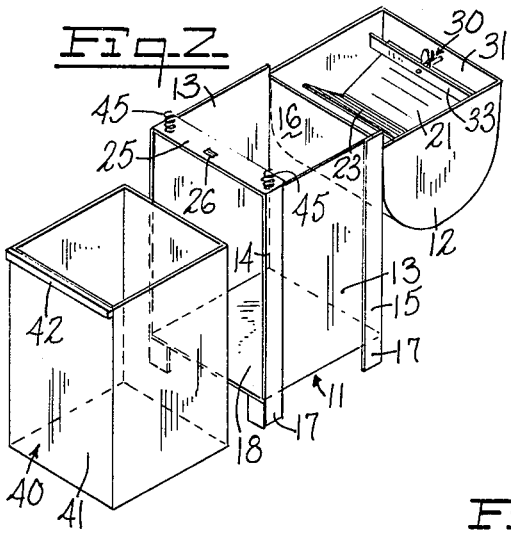
FIG. 2 represents a perspective view of the mail box, open and with the receptacle removed.

The hood may be fully opened, as shown in FIGS. 1 and 7, for cleaning the box or close inspection or repair thereof, or for removal of mail in case of accidental jamming of the receptacle, but in regular operation the amount of opening indicated in FIGS. 5 and 6 will suffice to free the receptacle and permit its replacement.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

What I claim is:

1. A mail box comprising a base, a hood and a removable receptacle, the base being generally rectangular and having an open front, the receptacle being adapted to fit within the base and having a front wall adapted to close the open front of the base, and the hood being hinged to the base for movement between open and closed positions, one lower edge of the hood being adapted to engage the front wall of the receptacle when the hood is closed, and the hood being provided with locking means for securing the hood in closed position, the base including a locking bar defining the top of the open front, and the locking means including a hook adapted to engage said bar in locking position and a cam adapted to lift the hood to free the front wall of the receptacle when the locking means is actuated to unlocking position.

2. A mail box according to claim 1 wherein the hood has a front wall and the locking means is mounted on said front wall.

3. A mail box according to claim 2 wherein the base includes a locking bar defining the top of the open front, and the locking means includes a handle lock in the front wall of the hood, a spindle extending rearwardly from said wall and a locking hook-cam on said spindle, the hook portion being adapted to engage releasably the locking bar and the cam portion being adapted to lift the front wall of the hood to free the receptacle.

4. A mail box comprising a base, a hood and a removable receptacle, the base being generally rectangular and having an open front defined upwardly by a locking bar having a central slot, the receptacle being adapted to fit within the base and having a front wall adapted to close the open front of the base, the upper edge of said front wall lying adjacent the locking bar, and the hood being hinged to the base adjacent the back upper edge thereof for movement between open and closed positions, the hood having a front wall the lower edge of which is adapted to engage the front wall of the receptacle when the hood is closed and the hood being provided with locking means mounted on said front wall, said means including a hook adapted to be engaged in the locking bar slot in locking position and a cam adapted to bear on the locking bar to lift the hood in order to free the front wall of the receptacle when the locking means is actuated to unlocking position.

* * * * *